US010016070B1

(12) United States Patent
DeSena et al.

(10) Patent No.: US 10,016,070 B1
(45) Date of Patent: Jul. 10, 2018

(54) PULL-SLIDE SYSTEM AND METHOD FOR SUSPENDED MERCHANDISE ITEMS

(71) Applicant: Henschel-Steinau, Inc., Allendale, NJ (US)

(72) Inventors: Michael D. DeSena, West Caldwell, NJ (US); Andrew B. Sholl, Cranbury, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 320 days.

(21) Appl. No.: 14/851,504

(22) Filed: Sep. 11, 2015

(51) Int. Cl.
*A47F 5/08* (2006.01)
*A47F 1/12* (2006.01)
*G09F 3/20* (2006.01)

(52) U.S. Cl.
CPC ..... *A47F 1/128* (2013.01); *A47F 1/126* (2013.01); *A47F 5/0823* (2013.01); *A47F 5/0869* (2013.01); *G09F 3/204* (2013.01)

(58) Field of Classification Search
CPC ..... A47F 1/128; A47F 1/125; A47F 1/126; A47F 5/0823; A47F 5/0006; A47F 5/08; A47F 5/0807; A47F 5/0838; A47F 5/0861; A47F 5/0853; A47F 5/0869; A47F 1/00; A47F 1/10; A47F 1/06; A47B 96/067; G09F 3/204; B42F 17/14; B42F 17/02; B65G 1/07; B65G 1/026; B65G 1/10
USPC ..... 211/54.1, 59.1, 59.3, 7, 51; 221/255, 221/227, 279; 206/817, 556; 312/61, 71
See application file for complete search history.

(56) References Cited

U.S. PATENT DOCUMENTS 3,785,501 A * 1/1974 Canning ..... A47F 5/0861 211/57.1
4,475,658 A * 10/1984 Roberts ..... A47F 5/0807 211/54.1
4,821,894 A * 4/1989 Dechirot ..... A47F 1/121 211/54.1
4,869,376 A * 9/1989 Valiulis ..... A47F 5/0823 211/54.1
5,009,334 A * 4/1991 Bodkins ..... A47F 1/128 211/54.1
5,114,021 A * 5/1992 Fredrickson ..... A47F 1/121 211/54.1
5,131,563 A * 7/1992 Yablans ..... A47F 1/126 221/124
5,222,608 A * 6/1993 Eklof ..... A47F 1/128 211/54.1
5,671,851 A * 9/1997 Johnson ..... A47F 1/128 211/106

(Continued)

*Primary Examiner* — Jennifer E. Novosad
(74) *Attorney, Agent, or Firm* — Arthur Jacob

(57) ABSTRACT

A system and method for displaying and dispensing items of merchandise placed in a row suspended from a cantilevered support mounts a track above the support, and couples a slide with the track for sliding movement along the track. An arm is carried by the slide and extends downwardly for engaging the row of items. A grip on the slide enables a purchaser or the merchant to grasp and manually move the slide and the arm from a rearward position, wherein the arm is located behind the row of items, toward a forward position so as to engage and move the row of items toward a forward point-of-purchase, thereby placing a forward-most item at the point-of-purchase. Upon release of the grip, a return spring returns the slide and the arm to the rearward position.

2 Claims, 2 Drawing Sheets

(56) References Cited

U.S. PATENT DOCUMENTS 5,711,432 A * 1/1998 Stein ..... A47F 5/0861 211/57.1
5,906,283 A * 5/1999 Kump ..... A47F 1/128 211/54.1
6,102,192 A * 8/2000 Tomuro ..... A47F 1/128 198/747
6,131,748 A * 10/2000 Kawasaki ..... A47F 1/128 211/54.1
6,158,598 A * 12/2000 Josefsson ..... A47F 1/121 211/54.1
6,474,478 B1 * 11/2002 Huehner ..... A47F 5/0861 211/4
7,219,806 B1 * 5/2007 Morrow ..... A47F 5/0869 211/59.1
7,533,784 B2 * 5/2009 Vlastakis ..... A47F 5/0861 221/151
7,566,037 B2 * 7/2009 Vogler ..... A47F 1/128 211/54.1
7,743,931 B2 * 6/2010 Barkdoll ..... A47F 5/0861 211/7
7,768,399 B2 * 8/2010 Hachmann ..... G08B 13/1472 340/568.1
7,905,364 B2 * 3/2011 Pail ..... A47F 5/0869 211/59.3
8,240,486 B2 * 8/2012 Niederhuefner ..... A47F 1/128 211/51
8,523,012 B2 * 9/2013 Richardson ..... A47F 5/0861 211/51
8,684,227 B2 * 4/2014 Richardson ..... A47F 5/0861 211/51
8,739,980 B2 * 6/2014 Valiulis ..... A47F 1/128 211/54.1
8,800,785 B2 * 8/2014 Kalafut ..... A47F 5/0861 211/103
9,339,123 B1 * 5/2016 Stoddard ..... A47F 1/126
2005/0006326 A1 * 1/2005 Josefsson ..... A47F 1/128 211/54.1
2005/0077257 A1 * 4/2005 Ahlund ..... A47F 1/128 211/54.1
2006/0157431 A1 * 7/2006 Nagelski ..... A47F 5/0861 211/54.1
2007/0102379 A1 * 5/2007 Strand ..... A47F 5/0823 211/59.1
2007/0170133 A1 * 7/2007 Bryson ..... A47F 1/128 211/94.01
2009/0057244 A1 * 3/2009 Conti ..... A47F 5/0861 211/7
2013/0105419 A1 * 5/2013 Kologe ..... A47F 5/0861 211/7
2015/0189999 A1 * 7/2015 Leyden ..... A47F 5/0861 211/7
2016/0367049 A1 * 12/2016 Wirengard ..... A47F 5/0838

* cited by examiner

PULL-SLIDE SYSTEM AND METHOD FOR SUSPENDED MERCHANDISE ITEMS

The present invention relates generally to the display and dispensing of suspended merchandise items and pertains, more specifically, to a pull-slide system and method for drawing suspended items of merchandise forward to present a forward-most of the suspended items for convenient selection at a point-of-purchase.

Currently, a very popular arrangement for displaying and dispensing certain merchandise such as, for example, bagged items, suspends the items from a cantilevered support projecting from a substantially vertical wall, with the items placed in a row extending from the wall toward a point-of-purchase. The items are slidable along the support, and a purchaser need merely withdraw a forward-most item in the row to release the selected item from the support at the point-of-purchase to complete the selection and ultimate sale.

One shortcoming of the above-described arrangement is that the forward-most item in the row is not always present at the point-of-purchase and it becomes necessary for the purchaser to reach into the display and pull an item forward for examination when deciding whether or not to complete a selection for purchase—sometimes resulting in an inadvertent removal of at least the forward-most item and a consequent inconvenience should the purchaser decide not to complete the purchase. Attempts at providing an automatic biasing of the items forward, toward the point-of-purchase, militate against a convenient removal of a selected item, or the simple return of an inadvertently removed item to the display. Accordingly, it would be advantageous to both the purchaser and the merchant if the items of merchandise could be presented fully for display at the point-of-purchase, and for convenient dispensing upon selection, while avoiding inadvertent removal of one or more items, and the consequent need for replacement of such inadvertently removed items.

The present invention provides a pull-slide system and method that avoids the above-outlined drawbacks. As such, the present invention attains several objects and advantages, some of which are summarized as follows: Provides for the display and dispensing of a forward-most item of merchandise in a row of such items suspended from a cantilevered support projecting toward a point-of-purchase; enables a purchaser to conveniently examine and selectively remove for purchase, an item of merchandise suspended in a row along a conventional, existing cantilevered support, and presented at a point-of-purchase; avoids an inadvertent removal and an inconvenient replacement of an item of merchandise placed at a point-of-purchase located at the terminal end of a cantilevered support from which such items are suspended for display at the point-of-purchase; provides a simple and effective system and method for the selection of an item of merchandise suspended from a conventional cantilevered support and displayed at a point-of-purchase located at the terminal end of the support; is entirely compatible with conventional, already installed cantilevered support display and dispensing arrangements; facilitates "fronting" by the merchant of the displayed items of merchandise by allowing a quick and convenient drawing forward of suspended items remaining in the display; facilitates the re-stocking of items of merchandise suspended in a row along a cantilevered support; provides an economical system and method as described above and capable of exemplary performance over an extended service life.

The above objects and advantages, as well as further objects and advantages, are attained by the present invention, which may be described briefly as a system for the display and dispensing of items of merchandise placed in a row suspended from a cantilevered support along a path of travel extending in a substantially horizontal direction, the cantilevered support having a length terminating at a point-of-purchase, the system comprising: a track extending between first and second ends and having a length corresponding to the length of the cantilevered support; a bracket at the first end of the track, the bracket being configured for mounting the track vertically above and horizontally coextensive with the cantilevered support; an elongate slide extending between a rearward end and a forward end, the slide being coupled with the track for sliding movement along the track in the horizontal direction, between the first and second ends of the track; an arm carried by the slide, adjacent the rearward end of the slide and projecting in a vertical direction downwardly into the path of travel of the items of merchandise; a grip adjacent the forward end of the slide for selective grasping and manual movement of the slide and the arm from a rearward position, wherein the arm is placed adjacent the first end of the track, and a forward position wherein the arm is placed adjacent the second end of the track; and a return spring biasing the slide and the arm in a horizontal direction rearwardly from the forward position toward the rearward position; whereby grasping of the grip and manual movement of the slide and the arm from the rearward position toward the forward position will engage the arm with a rearward-most item of merchandise in the row of items suspended from the cantilevered support and move the row of items of merchandise forward until a forward-most item in the row is moved to the point-of-purchase, and release of the grip will enable the bias of the return spring to return the slide and the arm to the rearward position.

In addition, the present invention provides a method for the display and dispensing of items of merchandise placed in a row suspended from a cantilevered support along a path of travel extending in a substantially horizontal direction, the cantilevered support having a length terminating at a point-of-purchase, the method comprising: extending a track between first and second ends, with the track having a length corresponding to the length of the cantilevered support; mounting the track vertically above and horizontally coextensive with the cantilevered support; coupling an elongate slide with the track for sliding movement along the track in horizontal directions, between the first and second ends of the track; extending an arm from the slide, adjacent a rearward end of the slide, so as to project in a vertical direction downwardly into the path of travel of the items of merchandise; providing a grip adjacent the forward end of the slide for selective grasping and manual movement of the slide and the arm from a rearward position, wherein the arm is placed adjacent the first end of the track, and a forward position, wherein the arm is placed adjacent the second end of the track; and biasing the slide and the arm with a biasing force in a horizontal direction rearwardly from the forward position toward the rearward position; whereby grasping of the grip and manual movement of the slide and the arm from the rearward position toward the forward position will engage the arm with a rearward-most item of merchandise in the row of items suspended from the cantilevered support and will move the row of items of merchandise forward until a forward-most item in the row is moved to the point-of-purchase, and release of the grip will enable the biasing force to return the slide and the arm to the rearward position.

The invention will be understood more fully, while still further objects and advantages will become apparent, in the following detailed description of preferred embodiments of the invention illustrated in the accompanying drawing, in which.

Figure 1:
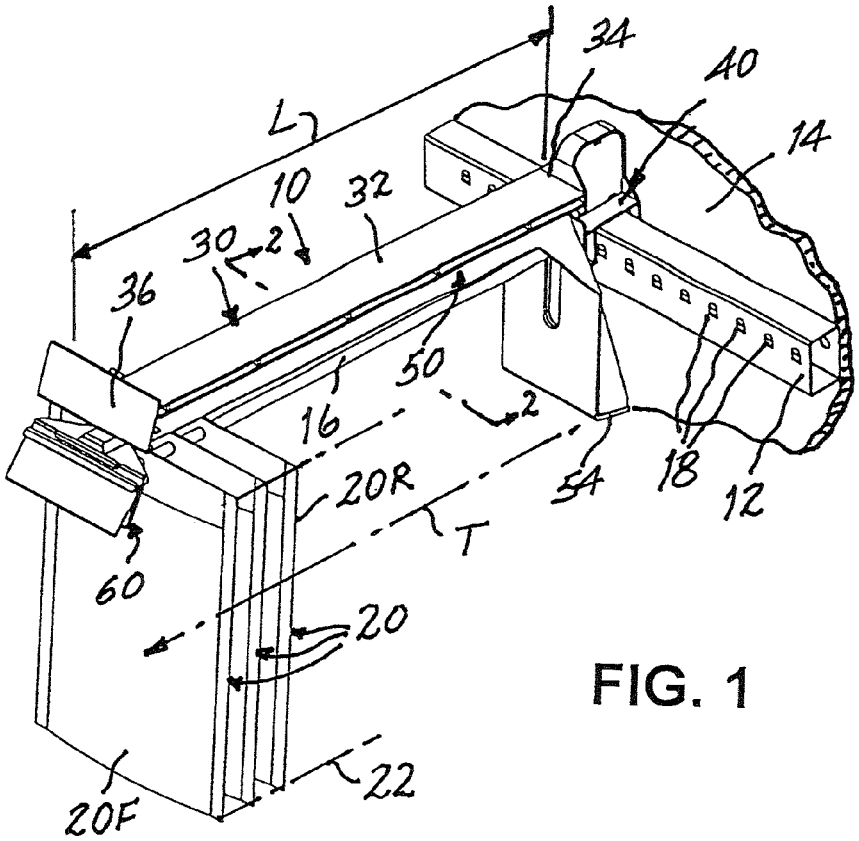
FIG. 1 is a top, front and right-side pictorial view of a pull-slide system constructed in accordance with the present invention and installed in connection with a conventional display and dispensing arrangement.
Figure 2:
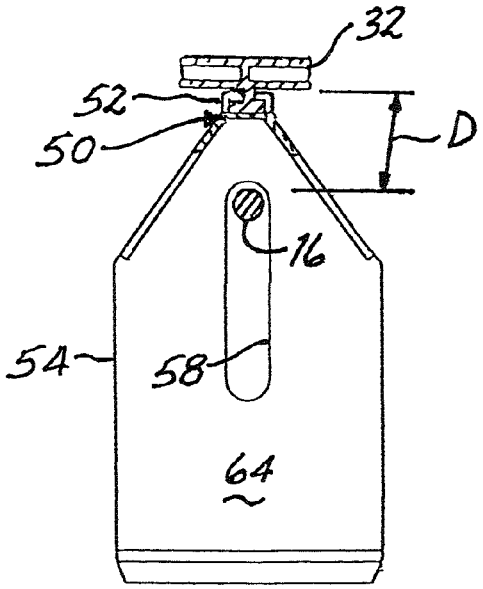
FIG. 2 is an enlarged cross-sectional view taken along line 2-2 of FIG. 1.

Referring now to the drawing, there is depicted a display and dispensing location 10 at which a conventional display and dispensing arrangement includes a perforated bar 12 mounted upon a substantially vertical wall 14 and carrying a cantilevered support in the form of a rod 16 secured within a selected on of a series of perforations 18 provided in bar 12, projecting in a generally horizontal direction from the wall 14. Items of merchandise, here shown in the form of bagged items 20, are suspended in a row 22 that follows a path of travel T extending from adjacent wall 14 to a terminal end 24 of rod 16 placed at a point-of-purchase 26. In a conventional manner, rod 16 is located selectively at any lateral position along bar 12, as established by perforations 18.

A pull-slide system constructed in accordance with the present invention is shown at 30 and is seen to include a track 32 having a length L corresponding generally to the length of rod 16, length L extending between a first end 34 and a second end 36 of track 32. A bracket 40 is integral with track 32 at the first end 34 thereof, and bracket 40 is configured for mounting the bracket 40 upon the bar 12, with the track 32 juxtaposed with rod 16, vertically above and horizontally coextensive with the rod 16. To that end, bracket 40 includes a base 42 for fitting over bar 12, base 42 including a recess 44 enabling the bracket 40 to straddle the rod 16 so that the track 32 is spaced at a predetermined vertical distance D above rod 16, and a detent 46 for reception in a corresponding one of the perforations 18 in bar 12 for securing the bracket 40, and the track 32, at a selected lateral location along the bar 12.

Figure 3:
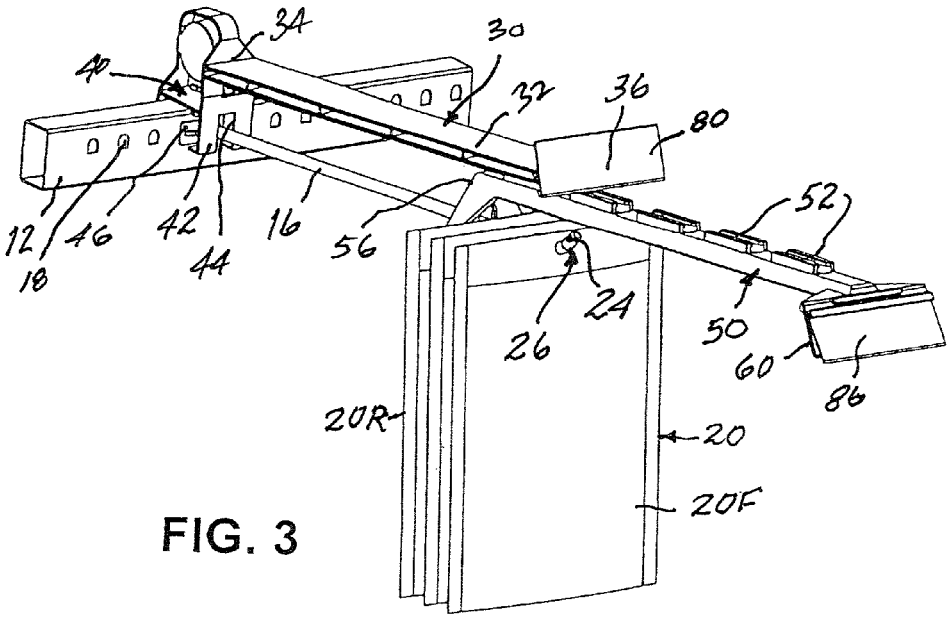
FIG. 3 is a top, front and left-side pictorial view of the pull-slide system with the component parts in another operating position.
Figure 4:
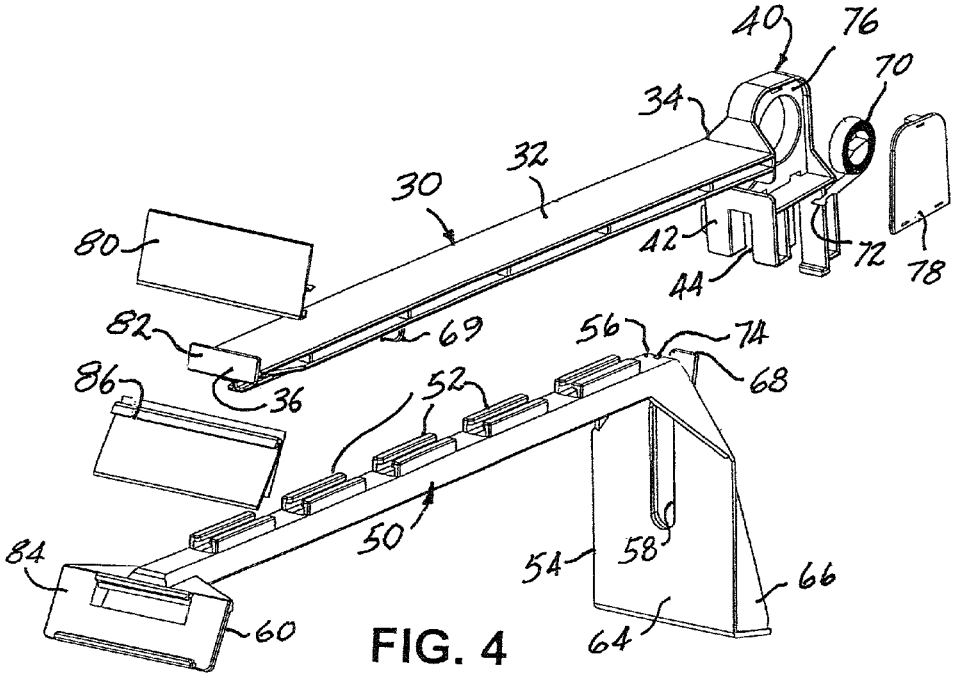
FIG. 4 is an exploded top, front and right-side pictorial view of the pull-slide system.

A slide member 50 is coupled with the track 32 by means of a plurality of horizontally spaced apart followers 52 which engage the track 32 for sliding movement of the slide member 50 in horizontal directions along track 32, between the ends 34 and 36. An arm 54 is integral with slide member 50 and depends downwardly from the rear end 56 of the slide member 50 to intercept the path of travel T of the items 20 suspended from rod 16, the arm 54 having an aperture 58 through which rod 16 extends. A grip in the form of a finger grip 60 is placed at the forward end 62 of slide member 50, enabling selective manual movement of the slide member 50 along track 32 between a retracted position, wherein the arm 54 is placed adjacent the first end 34 of track 32, as illustrated in FIG. 1, and an advanced position, wherein the arm 54 is placed adjacent the second end 36 of track 32, as illustrated in FIG. 3. Thus, upon grasping finger grip 60 and pulling slide member 50 forward, the rearward-most item 20R of the row 22 of items 20 will be engaged by arm 54 and the row 22 of items 20 will be moved forward by arm 54 until the forward-most item 20F is placed at the point-of-purchase 26, enabling a purchaser to examine the item 20F with convenience, and without the risk of an inadvertent removal of item 20F from rod 16. To that end, arm 54 includes a smooth, flat forward face 64 reinforced by integral rearward webs 66. In addition, as the items 20 are depleted along row 22, the merchant quickly and conveniently can "front" the remaining suspended items 20, that is, the remaining suspended items 20 can be drawn forward to present the forward-most item 20F at the point-of-purchase 26 to enhance the display of the remaining suspended items 20. With reference to FIG. 4, a stop mechanism includes a projection 68 placed on slide member 50, adjacent the rear end 56 of the slide member 50, and an abutment 69 placed on the track 32, adjacent second end 36 of track 32, for being engaged by the projection 68 to preclude forward movement of slide member 50 beyond the advanced position, thereby preventing a consequent inadvertent disengagement of the slide member 50 from track 32 during operation of the pull-slide system 30.

Once the purchaser, or the merchant, releases finger grip 60, a return spring, shown in the form of a constant force coil spring 70, coupled to slide member 50 by means of a tab 72 on spring 70 engaged within a slot 74 in slide member 50, will return slide member 50 from the advanced position to the retracted position of the slide member 50. In this manner, slide member 50 is maintained in the retracted position, out of the way of purchaser traffic when not selectively advanced. At the same time, the retracted position of slide member 50 maintains the suspended arm 54 located adjacent the first end 34 of track 32, thereby facilitating re-stocking of items 20 along rod 16, as necessary. Coil spring 70 is placed within a compartment 76 which is integral with bracket 40, with coil spring 70 enclosed behind a cover panel 78.

In order to assist a purchaser in identifying an item 20 suspended from rod 16, a graphics holder 80 is secured to a graphic display element, shown in the form of a tab 82, at the second end 36 of track 32 for displaying graphics related to item 20. In addition, finger grip 60 is provided with a price channel 84 within which a pricing information tag holder 86 may be inserted for ready view of pricing information by the purchaser.

Track 32 and slide member 50 each advantageously are molded of a synthetic polymeric material in a unitary construction, rendering the pull-slide system simple and economically manufactured, while facilitating installation for exemplary long-term use in connection with existing, already installed conventional cantilevered support display and dispensing arrangements.

It will be seen that the present invention attains all of the objects and advantages summarized above, namely: Provides for the display and dispensing of a forward-most item of merchandise in a row of such items suspended from a cantilevered support projecting toward a point-of-purchase; enables a purchaser to conveniently examine and selectively remove for purchase, an item of merchandise suspended in a row along a conventional, existing cantilevered support, and presented at a point-of-purchase; avoids an inadvertent removal and an inconvenient replacement of an item of merchandise placed at a point-of-purchase located at the terminal end of a cantilevered support from which such items are suspended for display at the point-of-purchase; provides a simple and effective system and method for the selection of an item of merchandise suspended from a conventional cantilevered support and displayed at a point-of-purchase located at the terminal end of the support; is entirely compatible with conventional, already installed cantilevered support display and dispensing arrangements;

facilitates "fronting" by the merchant of the displayed items of merchandise by allowing a quick and convenient drawing forward of suspended items remaining in the display; facilitates the re-stocking of items of merchandise suspended in a row along a cantilevered support; provides an economical system and method as described above and capable of exemplary performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A system for the display and dispensing of items of merchandise placed in a row suspended from a cantilevered support along a path of travel extending in a substantially horizontal direction, the cantilevered support having a length terminating at a point-of-purchase, the system comprising:

a track extending between first and second ends and having a length corresponding to the length of the cantilevered support;

a bracket at the first end of the track, the bracket being configured for mounting the track vertically above and horizontally coextensive with the cantilevered support;

an elongate slide having a length extending between a rearward end and a forward end and corresponding to the length of the track, the slide being coupled with the track for sliding movement along the track in the horizontal direction, between the first and second ends of the track;

an arm carried by the slide, adjacent the rearward end of the slide and projecting in a vertical direction downwardly into the path of travel of the items of merchandise;

a grip adjacent the forward end of the slide for selective grasping and manual movement of the slide and the arm from a rearward position, wherein the arm is placed adjacent the first end of the track, toward a forward position wherein the arm is placed adjacent the second end of the track; and a return spring biasing the slide and the arm in a horizontal direction rearwardly from the forward position toward the rearward position, the return spring being in the form of a constant-force coil spring mounted within the bracket;

whereby grasping of the grip and manual movement of the slide and the arm from the rearward position toward the forward position will engage the arm with a rearward-most item of merchandise in the row of items suspended from the cantilevered support and move the row of items of merchandise forward until a forward-most item in the row is moved to the point-of-purchase, and release of the grip will enable the bias of the return spring to return the slide and the arm to the rearward position.

2. A system for the display and dispensing of items of merchandise placed in a row suspended from a cantilevered support along a path of travel extending in a substantially horizontal direction, the cantilevered support having a length terminating at a point-of-purchase, the system comprising:

a track extending between first and second ends and having a length corresponding to the length of the cantilevered support;

a bracket at the first end of the track, the bracket being configured for mounting the track vertically above and horizontally coextensive with the cantilevered support;

the track and the bracket being molded of a synthetic polymeric material in a unitary construction;

an elongate slide having a length extending between a rearward end and a forward end and corresponding to the length of the track, the slide being coupled with the track for sliding movement along the track in the horizontal direction, between the first and second ends of the track;

an arm carried by the slide, adjacent the rearward end of the slide and projecting in a vertical direction downwardly into the path of travel of the items of merchandise;

a grip adjacent the forward end of the slide for selective grasping and manual movement of the slide and the arm from a rearward position, wherein the arm is placed adjacent the first end of the track, toward a forward position wherein the arm is placed adjacent the second end of the track; and a return spring biasing the slide and the arm in a horizontal direction rearwardly from the forward position toward the rearward position, the return spring being in the form of a constant-force coil spring housed within the bracket;

whereby grasping of the grip and manual movement of the slide and the arm from the rearward position toward the forward position will engage the arm with a rearward-most item of merchandise in the row of items suspended from the cantilevered support and move the row of items of merchandise forward until a forward-most item in the row is moved to the point-of-purchase, and release of the grip will enable the bias of the return spring to return the slide and the arm to the rearward position.

* * * * *